US009291951B2

(12) United States Patent
Woo et al.

(10) Patent No.: US 9,291,951 B2
(45) Date of Patent: Mar. 22, 2016

(54) IMAGE FORMING APPARATUS HAVING DEVELOPING UNIT

(71) Applicant: Samsung Electronics Co., Ltd., Suwon-si (KR)

(72) Inventors: Sang Bum Woo, Yongin-si (KR); Sung Dae Kim, Suwon-si (KR); Soo Yong Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 23 days.

(21) Appl. No.: 14/281,155

(22) Filed: May 19, 2014

(65) Prior Publication Data

US 2014/0348531 A1 Nov. 27, 2014

(30) Foreign Application Priority Data

May 22, 2013 (KR) ..... 10-2013-0057594

(51) Int. Cl.
*G03G 15/16* (2006.01)
*G03G 15/00* (2006.01)

(52) U.S. Cl.
CPC ..... *G03G 15/1605* (2013.01); *G03G 15/1685* (2013.01); *G03G 15/5058* (2013.01)

(58) Field of Classification Search
CPC ..... G03G 15/01; G03G 15/0105; G03G 15/0121; G03G 15/0131; G03G 15/0142; G03G 15/0147; G03G 15/0152; G03G 15/0178; G03G 15/0184; G03G 15/0189; G03G 15/0194; G03G 15/0818; G03G 15/162; G03G 15/75; G03G 2215/025
See application file for complete search history.

(56) References Cited

U.S. PATENT DOCUMENTS

2009/0068576 A1* 3/2009 Hongo et al. ..... 430/57.1
2012/0269528 A1* 10/2012 Ito et al. ..... 399/53

* cited by examiner

*Primary Examiner* — Joseph S Wong
(74) *Attorney, Agent, or Firm* — Staas & Halsey LLP

(57) ABSTRACT

Disclosed herein is an image forming apparatus that has a developing unit, an intermediate transfer body, and a transfer roller and may prevent contamination of the transfer roller and a printing medium by the toner remaining in a test pattern forming area of the intermediate transfer body. The image forming apparatus includes a developing unit to allow an image to be formed by a developing agent, an intermediate transfer body provided with an image forming area and a test pattern forming area, the image being transferred from the developing unit to the image forming area and the test pattern forming area, and a transfer roller allowing the image to be transferred from the image forming area to a printing medium, wherein a maximum transfer length of the transfer roller is less than a maximum image forming length of the developing unit.

14 Claims, 7 Drawing Sheets

IMAGE FORMING APPARATUS HAVING DEVELOPING UNIT

CROSS-REFERENCE TO RELATED APPLICATIONS

This application claims the priority benefit of Korean Patent Application No. 10-2013-0057594, filed on May 22, 2013 in the Korean Intellectual Property Office, the disclosure of which is incorporated herein by reference.

BACKGROUND

1. Field

Embodiments to an image forming apparatus having a developing unit, an intermediate transfer body, and a transfer roller.

2. Description of the Related Art

In an image forming apparatus having a developing unit, an intermediate transfer body, and a transfer roller, a transfer roller is used to transfer toner transferred to the intermediate transfer body to a printing medium. That is, when a printing medium passes through a gap between the intermediate transfer body and the transfer roller, the transfer roller transfers the toner transferred to the intermediate transfer body to the printing medium. The transfer roller contacts the intermediate transfer body, forming a nip. A separate test pattern is transferred to the intermediate transfer body to conduct color registration or adjustment of color tone. Some of the toner used to form the test pattern often remains on the intermediate transfer body even after removing of the toner is performed.

While no printing medium enters the gap between the intermediate transfer body and the transfer roller, the toner remaining in the test pattern forming area of the intermediate transfer body may contaminate the transfer roller. The contaminated transfer roller may in turn contaminate the rear surfaces of subsequent printing media entering the space between the intermediate transfer body and the transfer roller to allow printing thereon.

SUMMARY

In an aspect of one or more embodiments, there is provided an image forming apparatus that has a developing unit, an intermediate transfer body, and a transfer roller and may prevent contamination of the transfer roller and a printing medium by the toner remaining in a test pattern forming area of the intermediate transfer body.

In an aspect of one or more embodiments, there is provided an image forming apparatus which includes a developing unit to form an electrostatic latent image and allow an image to be formed by a developing agent supplied to the electrostatic latent image, an intermediate transfer body having an image forming area and a test pattern forming area arranged in parallel in a primary scanning direction, wherein the image is transferred from the developing unit to the image forming area and the test pattern forming area, and a transfer roller allowing the image transferred to the image forming area of the intermediate transfer body to be transferred to a printing medium, wherein a maximum transfer length, which may be a maximum length of the transfer roller allowing transfer of the image to the printing medium, is less than a maximum image forming length, which may be a maximum length of the developing unit allowing the image to be developed, wherein the transfer roller may be positioned so that the maximum transfer length of the transfer roller corresponds to the image forming area of the intermediate transfer body, which may be outside of the test pattern forming area of the intermediate transfer body.

The developing unit may include a photosensitive medium, a developing roller, and a charging roller, wherein portions of the photosensitive medium, developing roller, and charging roller overlap each other in the primary scanning direction which may correspond to the maximum image forming length.

The maximum image forming length may include a length of the test pattern forming area and a length of the image forming area.

The maximum transfer length of the transfer roller may be greater than a length in the primary scanning direction of a printing medium with the largest size supported by the image forming apparatus.

A cleaning unit to clean only a test pattern formed in the test pattern forming area may be installed at a position corresponding to the test pattern forming area in the image forming apparatus.

The intermediate transfer body may be a transfer belt.

The intermediate transfer body may be a transfer drum.

In an aspect of one or more embodiments, there is provided an image forming apparatus which includes a developing unit to form an electrostatic latent image and allow an image to be formed by a developing agent supplied to the electrostatic latent image, an intermediate transfer body having an image forming area and two test pattern forming areas arranged at both sides of the image forming area to be parallel with the image forming area in a primary scanning direction, wherein the image is transferred from the developing unit to the image forming area and the two test pattern forming areas, wherein the two test pattern forming areas may include a first test pattern forming area formed on one side of the image forming area and a second test pattern forming area formed on the other side of the image forming area; and a transfer roller allowing the image transferred to the image forming area of the intermediate transfer body to be transferred to a printing medium, wherein a maximum transfer length, which may be a maximum length of the transfer roller allowing transfer of the image to the printing medium is less than a maximum image forming length, which may be a maximum length of the developing unit allowing the image to be developed, wherein the transfer roller may be positioned so that the maximum transfer length of the transfer roller corresponds to the image forming area of the intermediate transfer which may be outside of the two test pattern forming areas of the intermediate transfer body.

The developing unit may include a photosensitive medium, a developing roller, and a charging roller, wherein portions of the photosensitive medium, developing roller, and charging roller overlap each other in the primary scanning direction which may correspond to the maximum image forming length.

The maximum image forming length may include lengths of the two test pattern forming areas and a length of the image forming area.

The maximum transfer length of the transfer roller may be greater than a length in the primary scanning direction of a printing medium with the largest size supported by the image forming apparatus.

A cleaning unit to clean only a test pattern formed in the test pattern forming area may be installed at a position corresponding to the test pattern forming area.

Two cleaning units to clean only test patterns formed in the two test pattern forming areas may be installed at positions corresponding to the two test pattern forming areas in the image forming apparatus.

The intermediate transfer body may be a transfer belt.

The intermediate transfer body may be a transfer drum.

DETAILED DESCRIPTION

Figure 1:
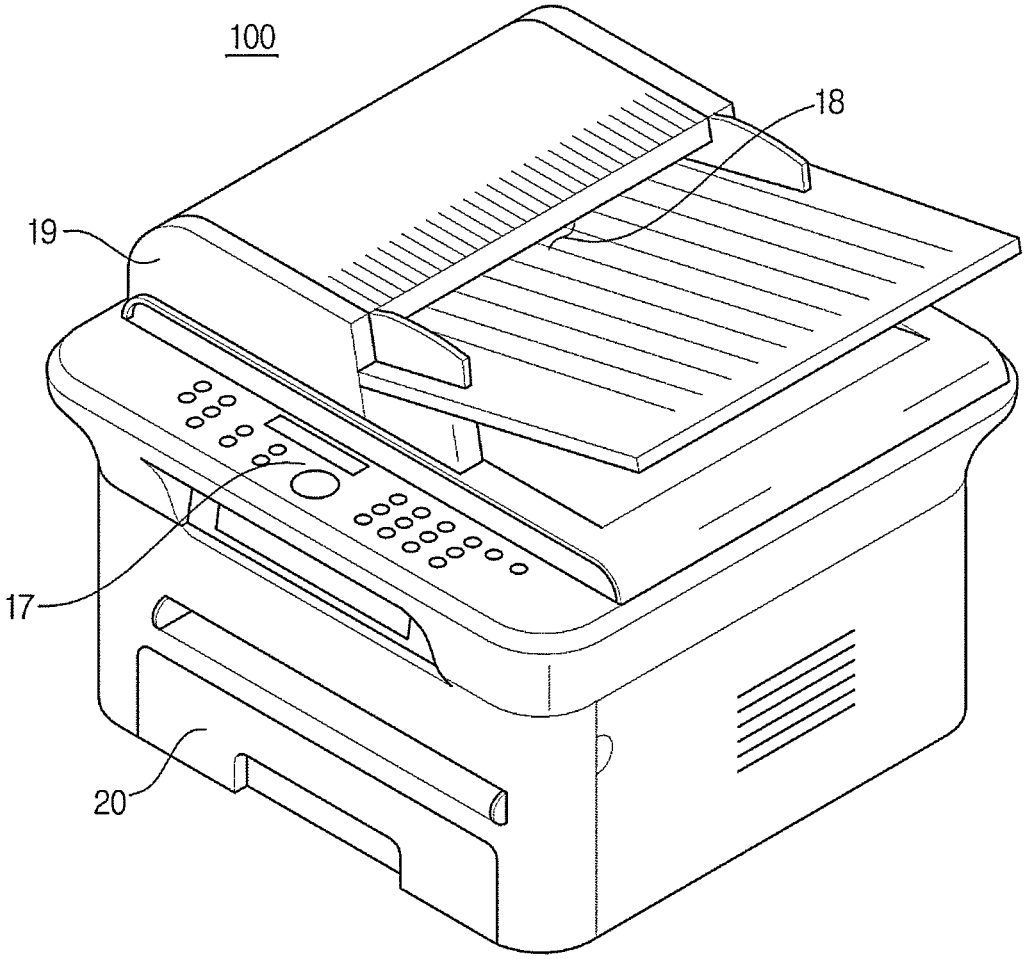
FIG. 1 is a view illustrating an image forming apparatus according to an exemplary embodiment.

Reference will now be made in detail to embodiments of the present disclosure, examples of which are illustrated in the accompanying drawings, wherein like reference numerals refer to like elements throughout.

FIG. 1 is a view illustrating an image forming apparatus according to an exemplary embodiment. As shown in FIG. 1, an automatic document feeder 19 is arranged at the upper portion of the image forming apparatus 100. The automatic document feeder 19 includes a feed unit 18 and a discharge unit 10*b* (see FIG. 2). A document (generally, a sheet of paper containing records) to be copied or scanned is inserted into the feed unit 18. The document inserted into the feed unit 18 undergoes a series of automatic transport processes in the image forming apparatus 100. Then, the document is scanned and discharged through the discharge unit 10*b* and stacked. The automatic document feeder 19 is installed such that it is openable. When the automatic document feeder 19 is opened (i.e., lifted up), sheets of the document may be manually fed one by one. A control panel is arranged on one surface of the image forming apparatus 100. The control panel 17 is provided with a keypad, buttons to switch power on/off, a navigation dial for manipulation of menu items, and a display. A cassette 20 to feed printing media is arranged on the front surface of the image forming apparatus 100. Plural printing media (generally, blank sheets of paper containing no recorded content) may be stacked on the cassette 20. A printing medium containing recorded content as a resultant of print or copy is discharged through the discharge unit 10*b* disclosed above. In the case of a laser printer shown in FIG. 1 as an example of the image forming apparatus, a series of operations including feeding, transferring, fusing, and discharging of the printing medium are performed in the image forming apparatus 100 to record specific content on the printing medium.

Figure 2:
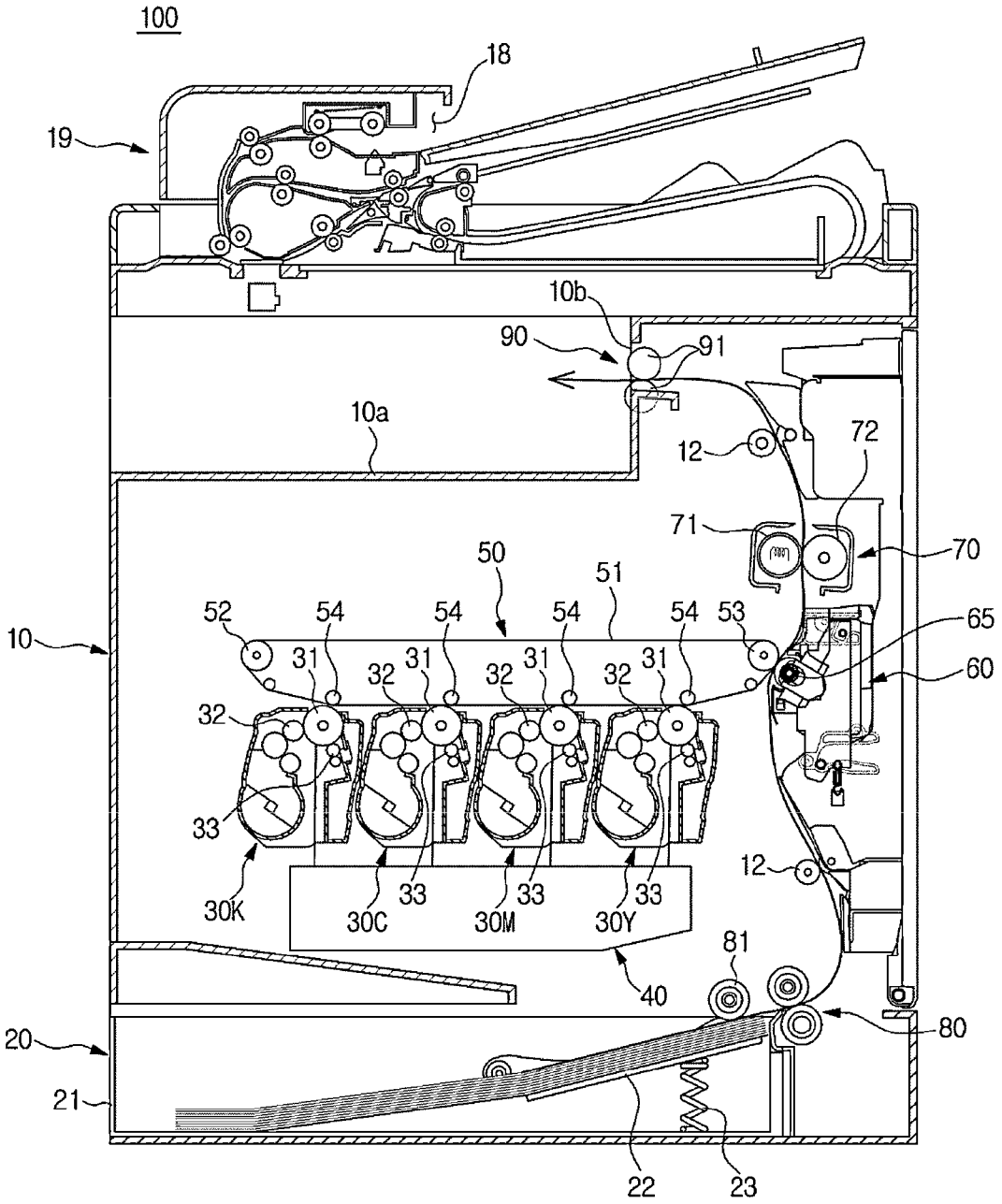
FIG. 2 is a view illustrating an internal structure of an image forming apparatus according to an exemplary embodiment.

FIG. 2 is a view illustrating an internal structure of an image forming apparatus according to one embodiment. The image forming apparatus 100 includes a body 10 forming an external appearance of the image forming apparatus 100, a cassette 20 allowing printing media to be stacked thereon, a plurality of developing units 30C, 30M, 30Y and 30K to turn an electrostatic latent image into a visible image using developing agents (e.g., toner) according to colors, an exposure unit 40 to emit light onto photosensitive media 31 of the developing units 30C, 30M, 30Y and 30K in a charged state and form an electrostatic latent image on each of the photosensitive media 31, a transfer device 50 to receive a printing medium from the cassette 20 and transfer a visible image formed on each of the photosensitive media 31 to the printing medium, and a fusing unit 70 to fuse, to the printing medium, the developing agent of the visible image transferred to the printing medium.

The body 10 is provided, at a top thereof, with a stacking section 10*a*, on which a printing medium having an image formed thereon is stacked. The stacking section 10*a* is provided, at one side thereof, with a discharge port 10*b*, through which the printing medium having an image formed thereon is discharged.

The cassette 20 includes a tray 21 movably installed in the body 10, a knock-up plate 22 disposed in the tray 21 and allowing printing media to be stacked thereon, and an elastic member 23 to elastically support the knock-up plate 22.

Each of the developing units 30C, 30M, 30Y and 30K includes a respective photosensitive medium 31. An electrostatic latent image is formed on a charged surface of the photosensitive medium 31 by the exposure unit 40. Each of the developing units 30C, 30M, 30Y and 30K also includes a developing roller 32 to supply a developing agent to the photosensitive medium 31, and a charging roller 33 to charge the surface of the photosensitive medium 31.

In an embodiment, the developing units 30C, 30M, 30Y and 30K include four developing units 30C, 30M, 30Y and 30K, each of which stores one of the developing agents of cyan (C), magenta (M), yellow (Y) and black (K) colors to develop an image in cyan (C), magenta (M), yellow (Y) and black (K) colors. The four developing units 30C, 30M, 30Y and 30K are disposed in parallel at the lower side of the transfer devices 50 and 60.

The exposure unit 40 emits light carrying image information onto the photosensitive media 31 provided to the respective developing units 30C, 30M, 30Y and 30K, forming an electrostatic latent image on the surface of the respective photosensitive media 31.

The transfer devices 50 and 60 include a first transfer unit 50, to which visible images formed on the developing units 30C, 30M, 30Y and 30K by the developing agents are transferred, and a second transfer unit 60 to transfer a visible image on the first transfer unit 50 to a printing medium. The second transfer unit 60 includes a transfer roller 65.

The fusing unit 70 includes a heating roller 71 to generate heat, and a pressing roller 72 having an outer circumferential surface made of an elastically deformable material and adapted to press the printing medium against an outer circumferential surface of the heating roller 71

In addition, the body 10 includes a pick-up unit 80 disposed at the upper portion of the cassette 20 to pick up printing media stacked on the knock-up plate 22 one by one, transport rollers 12 to guide a printing medium picked up by the pick-up unit 80 to an upper side, and a discharge unit 90 disposed at the upper side of the fusing unit 70 and at a portion of the body 10 adjacent to the discharge port 10*b* to allow the printing medium having passed through the fusing unit 70 to be discharged through the discharge port 10*b*. The pick-up unit 80 includes a pick-up roller 81 to pick up the printing media on the knock-up plate 22 one by one, and the discharge unit 90 includes a pair of discharge rollers 91 disposed inside the discharge port 10*b*.

In the image forming apparatus configured as above, the first transfer unit 50 includes a transfer belt 51 disposed in the body 10, which is an example of an intermediate transfer body to which the visible images of the developing agents formed on the photosensitive media 31 of the developing units 30C, 30M, 30Y and 30K are transferred in an overlapping manner, a drive roller 52 and a driven roller 53 disposed at opposite inner sides of the transfer belt 51 to rotate the transfer belt 51, a plurality of transfer rollers 54 disposed to face the photosensitive media 31 of the respective developing units 30C, 30M, 30Y and 30K with the transfer belt 51 interposed between each transfer roller 54 and the corresponding photosensitive medium 31 so as to allow visible images formed on the photosensitive media 31 to be transferred to the transfer belt 51, a transfer belt frame (not shown) at which both sides of each of the rollers 54, drive roller 52, and driven roller 53 are rotatably installed. As the intermediate transfer body, a transfer roller may be employed in place of the transfer belt 51.

Figure 3:
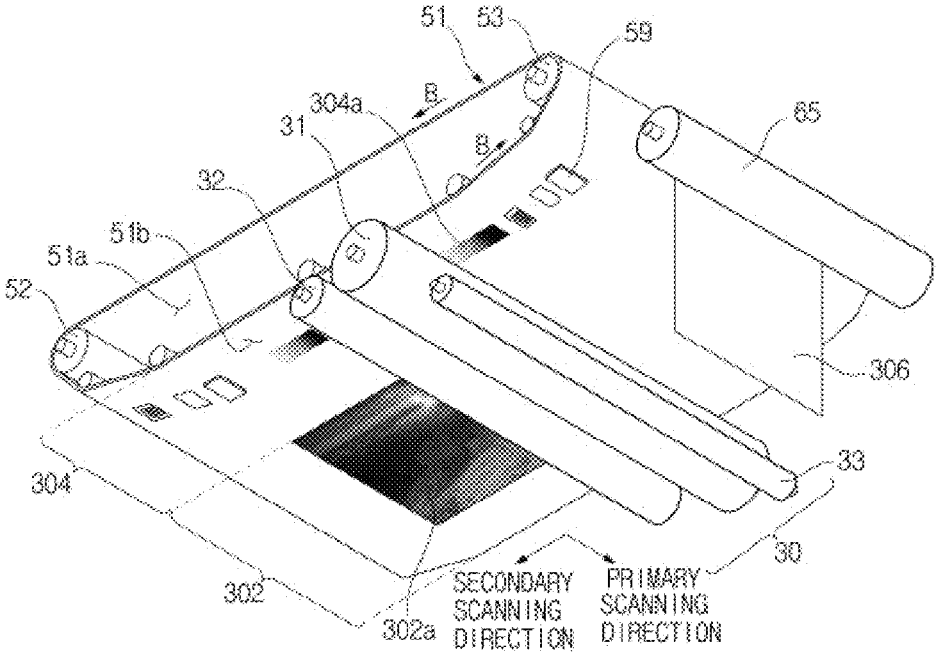
FIG. 3 is a view illustrating structures of a transfer belt and a developing unit of an image forming apparatus according to an exemplary embodiment.

FIG. 3 is a view illustrating structures of a transfer belt and a developing unit of an image forming apparatus according to one embodiment. In an embodiment, the image forming apparatus is provided with four developing units 30C, 30M, 30Y and 30K to implement four colors of cyan (C), magenta (M), yellow (Y) and black (K). However, in FIG. 3, one developing unit 30 among the four developing units 30C, 30M, 30Y and 30K is shown as a representative example, and the other three developing units are omitted. In addition, regarding the constituents of the developing unit 30, the photosensitive medium 31, developing roller 32, and charging roller 330 are shown, and the other constituents of the developing unit 30 are omitted.

The configuration of the transfer belt 51 will be first described with reference to FIG. 3. The transfer belt 51 having the shape of a closed loop is looped over the drive roller 52 and the driven roller 53, which are spaced apart from each other and fixed, in the form of an open belt such that the transfer belt 51 is tensioned to an extent equal to or greater than a certain extent by the drive roller 52 and the driven roller 53. The transfer belt 51 runs in a cycle along the outer circumferential surfaces of the drive roller 52 and the driven roller 53 in the direction indicated by arrow B according to rotation of the drive roller 52 and the driven roller 53. One surface of the transfer belt 51 that contacts the outer circumferential surfaces of the drive roller 52 and the driven roller 53 may be defined as an inner surface 51*a*, and the other surface of the transfer belt 51 that does not contact the drive roller 52 and the driven roller 53 may be defined as the outer surface 51*b*. According to this definition, the outer surface 51*b* of the transfer belt 51 is provided with an image forming area 302 and an auto color registration (ACR) test pattern forming area 304. The image forming area 302 of the transfer belt 51 is an area where an image to be printed onto a printing medium 306 turns into a visible image 302*a* through a developing agent (e.g., toner). The ACR test pattern forming area 304 is provided in a section of the outer surface 51*b* of the transfer belt 51 next to the image forming area 302 where the visible image 302*a* is not formed. That is, the visible image 302*a* and an ACR test pattern 304*a* are formed in parallel on the outer surface 51*b* of the transfer belt 51 in the primary scanning direction. The ACR test pattern 304*a*, which is a test pattern for color position correction and color density correction, is formed in the ACR test pattern forming area 304 of the transfer belt 51. The shape, spacing and color of the ACR test patterns 304*a* formed in the ACR test pattern forming area 304 are detected by a test pattern detector 59 and transmitted to the controller (e.g., the CPU) of the image forming apparatus. The test pattern detector 59 includes a light emitting part to emit light to the outer surface 51*b* of the transfer belt 51 and a light receiving part to receive light reflected from the outer surface 51*b* of the transfer belt 51. The test pattern detector 59, which is designed to detect the shape, spacing and color of the ACR test patterns 304*a* formed on the outer surface 51*b* of the transfer belt 51, is installed at a position on the movement trajectory of the transfer belt 51 where the ACR test pattern 304*a* is formed, such that the test pattern detector 59 is spaced apart from the outer surface 51*b* of the transfer belt 51. The installation position of the test pattern detector 59 as above allows the test pattern detector 59 to detect the shape, spacing and color of the ACR test patterns 304*a* formed in the ACR test pattern forming area 304 of the outer surface 51*b* of the transfer belt 51 while the transfer belt 51 moves.

In addition, the developing unit 30 shown in FIG. 3 is configured as follows. In FIG. 3, only the photosensitive medium 31, the developing roller 32 and the charging roller 33 of the developing unit 30 are shown and the other constituents of the developing unit 30 are omitted. The photosensitive medium 31 is rotatably installed and slightly spaced apart from the outer surface 51*b* of the transfer belt 51. When the visible image 302*a* is formed on the outer surface 51*b* of the image forming area 302 of the transfer belt 51, or when the ACR test pattern 304*a* is formed in the ACR test pattern forming area 304, the photosensitive medium 31 moves toward the transfer belt 51 and contacts the outer surface 51*b* of the transfer belt 51 such that the visible image 302*a* is formed. To this end, the developing roller 32 and the charging roller 33 also move to the transfer belt 51 along with the photosensitive medium 31. However, the developing roller 32 and the charging roller 33 do not contact the outer surface 51*b* of the transfer belt 51. Accordingly, the developing roller 32 and the charging roller 33 are joined to the photosensitive medium 31 such that the developing roller 32 and the charging roller 33 are father spaced apart from the outer surface 51*b* of the transfer belt 51 than the photosensitive medium 31.

The transfer roller 65 is rotatably installed at a position adjacent to the driven roller 53, which supports one end of the transfer belt 51. That is, during circulating movement of the transfer belt 51, the transfer belt 51 passes through the gap between the driven roller 53 and the transfer roller 65. In addition, a printing medium 306 passes through the gap between the outer surface 51*b* of the transfer belt 51 and the transfer roller 65. The transfer roller 65 causes the visible image 302*a* formed in the image forming area 302 of the transfer belt 51 to be transferred to the surface of the printing medium 306. That is, while the transfer belt 51 moves in a circulating manner and the printing medium 306 passes through the gap between the transfer belt 51 and the transfer roller 65, the transfer roller 65 causes the developing agent (e.g., toner) staying in the image forming area 302 of the transfer belt 51 to be transferred to the surface of the printing medium 306.

Figure 4:
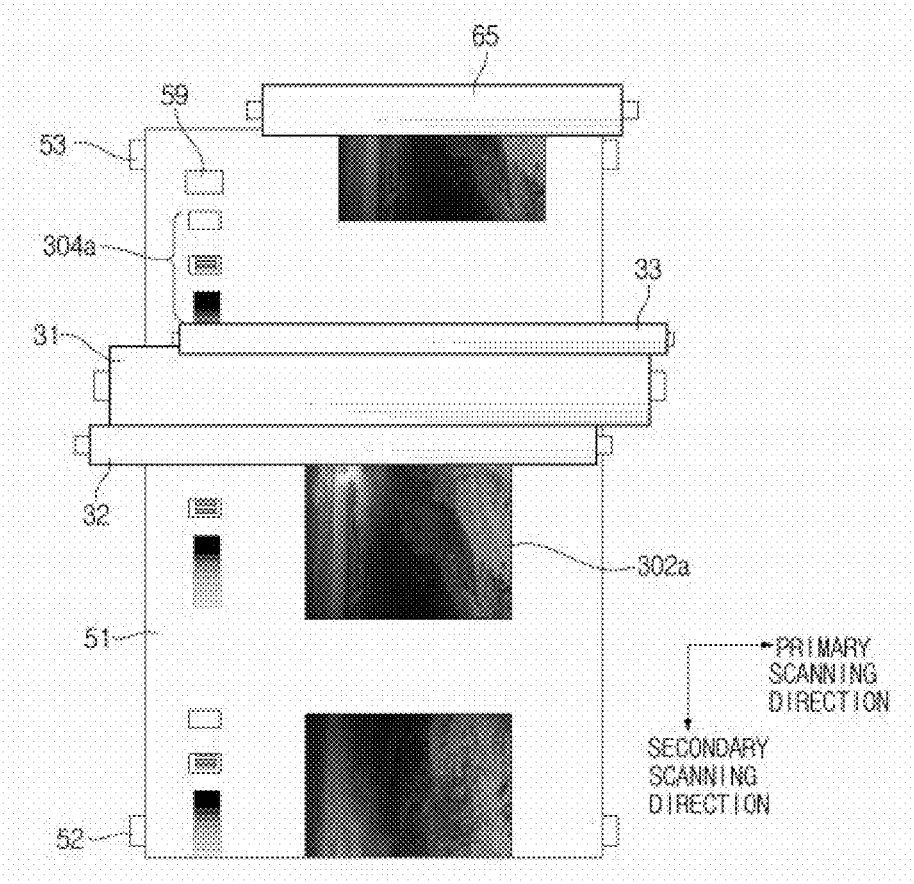
FIG. 4 is a plan view illustrating the transfer belt and the developing unit shown in FIG. 3.

FIG. 4 is a plan view illustrating the transfer belt and the developing unit shown in FIG. 3. Particularly, FIG. 4 shows the transfer belt 51 and the developing unit 30 viewed in the direction perpendicular to the outer surface 51*b* of the transfer belt 51. In the image forming apparatus according to an embodiment, the photosensitive medium 31, the developing roller 32, the charging roller 33, and the transfer roller 65 are configured to have lengths and installation positions as shown in FIG. 4 in order to allow the visible image 302*a* and the ACR test pattern 304*a* to be normally formed on the outer surface 51*b* of the transfer belt 51 and to prevent contamination of the transfer roller 65 by the ACR test pattern 304*a*. In this configuration, a cleaning unit (not shown) to remove the ACR test pattern 304*a* is needed, but a cleaning unit to prevent contamination of the transfer roller 65 by the visible image 302*a* is not needed.

As shown in FIG. 4, the visible image 302*a* and the ACR test pattern 304*a* are formed in parallel on the outer surface 51*b* of the transfer belt 51 and laterally separated from each other in the primary scanning direction. In an embodiment, the visible image 302*a* formed on the transfer belt 51 directly contacts the transfer roller 65 without assistance of a separate cleaning unit (not shown). During the printing operation, the printing medium 306 passes through the gap between the transfer belt 51 and the transfer roller 65. Accordingly, the visible image 302*a* formed on the outer surface 51*b* of the transfer belt 51 is normally transferred to the printing medium 306, and thus the transfer roller 65 is not contaminated. In addition, the ACR test pattern 304*a* does not contact the transfer roller 65. Accordingly, even if the ACR test pattern 304*a* is not cleaned, the ACR test pattern 304*a* passes through the transfer roller 65 without contaminating the transfer roller 65 after being detected by the test pattern detector 59. Then, the ACR test pattern 304*a* is cleaned and removed from the transfer belt 51 by the cleaning unit (not shown) before another ACR test pattern is formed.

Figure 5A:
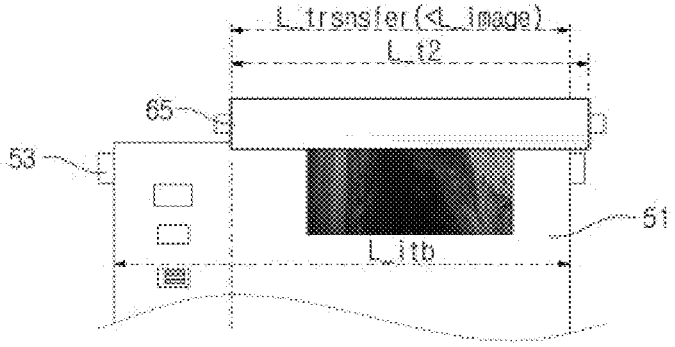
FIGS. 5A and 5B are views illustrating a relationship between the lengths of the transfer roller and photosensitive medium, the developing roller, and the charging roller and the length of the transfer belt in the primary scanning direction (i.e., the width of the transfer belt)
Figure 5B:
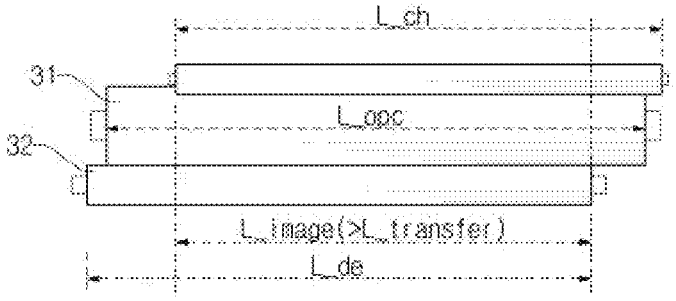

FIGS. 5A and 5B are views illustrating a relationship of the lengths of the transfer roller, photosensitive medium, developing roller, and charging roller to the length of the transfer belt in the primary scanning direction (i.e., the width of the transfer belt). The term "length" referred to in the following description denotes the length of the transfer belt 51 in the primary scanning direction. If the length needs to be defined in a direction other than the primary scanning direction of the transfer belt 51, the length will be defined otherwise.

FIG. 5A illustrates a relation of the length of the transfer roller 65 to the length of the transfer belt 51 in the primary scanning direction (i.e., the width of the transfer belt 51). As shown in FIG. 5A, the maximum transfer length L_transfer allowing transfer of the developing agent to the printing medium 306 corresponds to the overlapping portions of the transfer roller 65 and the transfer belt 51. The developing agent (e.g., toner) is not transferred to the printing medium 306 through the portion of the transfer belt 51 which does not overlap the transfer roller 65. The maximum transfer length L_transfer is equal to the length of the image forming area 302 (the length in the primary scanning direction). Herein, contamination of the transfer roller 65 by the ACR test pattern 304*a* does not occur only when the maximum transfer length L_transfer is less than the maximum image forming length L_image, which will be described later, and greater than the maximum length of the printing medium 306 in the primary scanning direction (i.e., the lateral width) that is supported by the image forming apparatus.

The maximum image forming length L_image shown in FIG. 5B is determined by the portions of the photosensitive medium 31, the developing roller 32 and the charging roller 33 overlapping one another. The maximum image forming length L_image, namely the maximum length of an image developed on the photosensitive medium 31 is the length of the overlapping portion of the charging roller length (L_ch), the photosensitive medium length (L_opc), and the developing roller length (L_de). In a part of the overlapping portion which is exposed to light from a laser scanning unit (not shown), the developing agent (toner) from the developing roller 32 is formed. The maximum image forming length L_image includes both the length of the image forming area 302 in which the visible image 302*a* is formed, and the length of the test pattern area 304 in which the ACR test pattern 304*a* is formed. Of the maximum image forming length L_image, the length (the length in the primary scanning direction) of the image forming area 302 is determined as the maximum length (the lateral width) of the printing medium 306 supported by the image forming apparatus.

How to determine the maximum transfer length L_transfer and the maximum image forming length L_image has been described above with reference to FIGS. 5A and 5B. To implement both the visible image 302*a* and the ACR test pattern 304*a* and prevent contamination of the transfer roller 65, the maximum transfer length L_transfer and the maximum image forming length L_image should satisfy the relation of L_transfer<L_image, and the position where the maximum transfer length L_transfer is formed should be set at the location corresponding to the image forming area 302 out of the test pattern forming area 304. This is intended to prevent contamination of the transfer roller 65 by the ACR test pattern 304*a* by limiting the length and position of the image forming area 302 where the visible image 302*a* may be formed, specifically by setting the position at a location out of the test pattern forming area 304 since the maximum transfer length L_transfer is involved in forming the visible image 302*a* in the image forming area 302. In addition, to print an image on the printing medium 306 with the maximum size supported by the image forming apparatus, the maximum transfer length L_transfer needs to be greater than the length in the primary scanning direction (i.e., the lateral width) L_medium of the printing medium 306. That is, to prevent contamination of the transfer roller 65 and ensure normal printing, the relation of L_medium<L_transfer<L_image should be satisfied.

Figure 6:
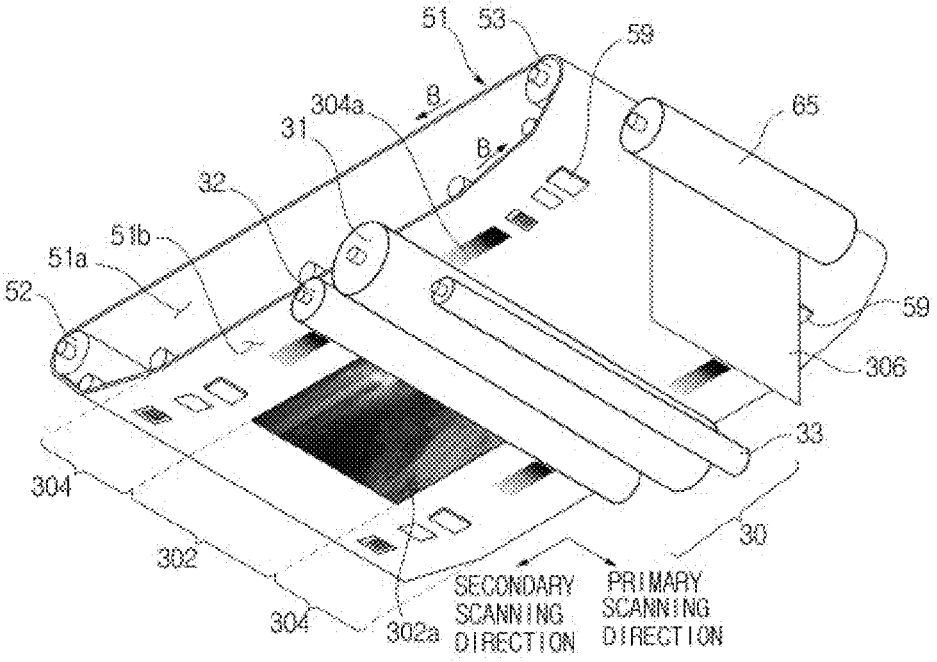
FIG. 6 is a view illustrating structures of a transfer belt and a developing unit of an image forming apparatus according to embodiment.

FIG. 6 is a view illustrating structures of a transfer belt and a developing unit of an image forming apparatus according to an embodiment. In an embodiment, the image forming apparatus is provided with four developing units 30C, 30M, 30Y and 30K to implement four colors of cyan (C), magenta (M), yellow (Y) and black (K). However, in FIG. 6, one developing unit 30 among the four developing units 30C, 30M, 30Y and 30K is shown as a representative example, and the other three developing units are omitted. In addition, regarding the constituents of the developing unit 30, the photosensitive medium 31, developing roller 32, and charging roller 330 are shown, and the other constituents of the developing unit 30 are omitted.

The configuration of the transfer belt 51 will be first described with reference to FIG. 6. The transfer belt 51 having the shape of a closed loop is looped over the drive roller 52 and the driven roller 53, which are spaced apart from each other and fixed, in the form of an open belt such that the transfer belt 51 is tensioned to an extent equal to or greater than a certain extent by the drive roller 52 and the driven roller 53. The transfer belt 51 runs in a cycle along the outer circumferential surfaces of the drive roller 52 and the driven roller 53 in the direction indicated by arrow B according to rotation of the drive roller 52 and the driven roller 53. One surface of the transfer belt 51 that contacts the outer circumferential surfaces of the drive roller 52 and the driven roller 53 may be defined as an inner surface 51*a*, and the other surface of the transfer belt 51 that does not contact the drive roller 52 and the driven roller 53 may be defined as the outer surface 51*b*. According to this definition, the outer surface 51*b* of the transfer belt 51 is provided with an image forming area 302 and an auto color registration (ACR) test pattern forming area

304. The image forming area 302 positioned at the center of the transfer belt 51 in the primary scanning direction is an area where an image to be printed onto a printing medium 306 turns into a visible image 302*a* through a developing agent (e.g., toner). The ACR test pattern forming area 304 is provided in a section of the outer surface 51*b* of the transfer belt 51 next to the image forming area 302 where the visible image 302*a* is not formed. That is, an ACR test pattern 304*a*, a visible image 302*a* and another ACR test pattern 304*a* are formed in parallel on the outer surface 51*b* of the transfer belt 51 along the primary scanning direction. The ACR test patterns 304*a*, which are test patterns for color position correction and color density correction, are formed in the ACR test pattern forming area 304 of the transfer belt 51. The shape, spacing and color of the ACR test patterns 304*a* formed in the ACR test pattern forming area 304 are detected by test pattern detectors 59 and transmitted to the controller (e.g., the CPU) of the image forming apparatus. Each of the test pattern detectors 59 includes a light emitting part to emit light to the outer surface 51*b* of the transfer belt 51 and a light receiving part to receive light reflected from the outer surface 51*b* of the transfer belt 51. In an embodiment, two test pattern detectors 59, which are designed to detect the shape, spacing and color of the ACR test patterns 304*a* formed on the outer surface 51*b* of the transfer belt 51, are installed at positions on the movement trajectory of the transfer belt 51 where the ACR test patterns 304*a* are formed, such that the test pattern detectors 59 are spaced apart from the outer surface 51*b* of the transfer belt 51. The installation position of the test pattern detectors 59 as above allows the test pattern detector 59 to detect the shape, spacing and color of the ACR test patterns 304*a* formed in the ACR test pattern forming area 304 of the outer surface 51*b* of the transfer belt 51 while the transfer belt 51 moves.

In addition, the developing unit 30 shown in FIG. 6 is configured as follows. In FIG. 6, only the photosensitive medium 31, the developing roller 32 and the charging roller 33 of the developing unit 30 are shown and the other constituents of the developing unit 30 are omitted. The photosensitive medium 31 is rotatably installed and a little spaced apart from the outer surface 51*b* of the transfer belt 51. When the visible image 302*a* is formed on the outer surface 51*b* of the image forming area 302 of the transfer belt 51, or when the ACR test pattern 304*a* is formed in the ACR test pattern forming area 304, the photosensitive medium 31 moves to the transfer belt 51 and contacts the outer surface 51*b* of the transfer belt 51 such that the visible image 302*a* is formed. To this end, the developing roller 32 and the charging roller 33 also move toward the transfer belt 51 along with the photosensitive medium 31. However, the developing roller 32 and the charging roller 33 do not contact the outer surface 51*b* of the transfer belt 51. Accordingly, the developing roller 32 and the charging roller 33 are joined to the photosensitive medium 31 such that the developing roller 32 and the charging roller 33 are father space apart from the outer surface 51*b* of the transfer belt 51 than the photosensitive medium 31.

The transfer roller 65 is rotatably installed at a position adjacent to the driven roller 53, which supports one end of the transfer belt 51. That is, during the circulating movement of the transfer belt 51, the transfer belt 51 passes through the gap between the driven roller 53 and the transfer roller 65. In addition, a printing medium 306 passes through the gap between the outer surface 51*b* of the transfer belt 51 and the transfer roller 65. The transfer roller 65 causes the visible image 302*a* formed in the image forming area 302 of the transfer belt 51 to be transferred to the surface of the printing medium 306. That is, while the transfer belt 51 moves in a circulating manner and the printing medium 306 passes through the gap between the transfer belt 51 and the transfer roller 65, the transfer roller 65 causes the developing agent (e.g., toner) in the image forming area 302 of the transfer belt 51 to be transferred to the surface of the printing medium 306.

Figure 7:
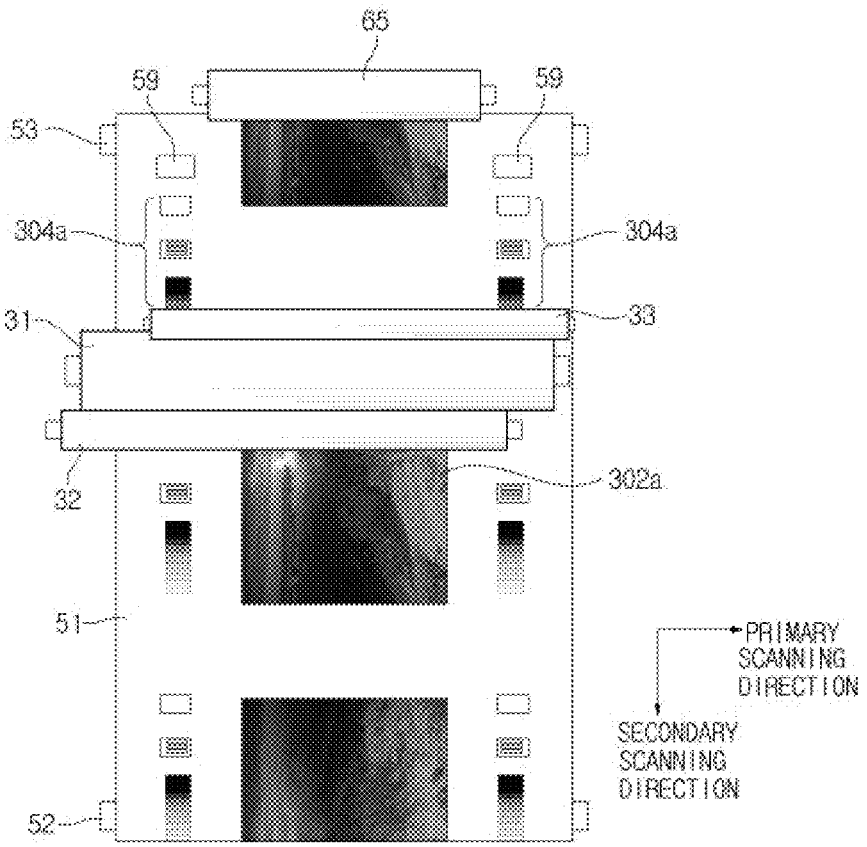
FIG. 7 is a plan view illustrating the transfer belt and the developing unit shown in FIG. 6.

FIG. 7 is a plan view illustrating the transfer belt and the developing unit shown in FIG. 6. Particularly, FIG. 7 shows the transfer belt 51 and the developing unit 30 viewed in the direction perpendicular to the outer surface 51*b* of the transfer belt 51. In the image forming apparatus according to an embodiment, the photosensitive medium 31, the developing roller 32, the charging roller 33, and the transfer roller 65 are configured to have lengths and installation positions as shown in FIG. 4 in order to allow the visible image 302*a* and the ACR test patterns 304*a* to be normally formed on the outer surface 51*b* of the transfer belt 51 and to prevent contamination of the transfer roller 65 by the ACR test pattern 304*a*. In this configuration, a cleaning unit (not shown) to remove the ACR test patterns 304*a* is needed, but a cleaning unit to prevent contamination of the transfer roller 65 by the visible image 302*a* is not needed.

As shown in FIG. 7, an ACR test pattern 304*a*, a visible image 302*a* and another ACR test pattern 304*a* are formed in parallel on the outer surface 51*b* of the transfer belt 51 and laterally separated from each other along the primary scanning direction. In an embodiment, the visible image 302*a* formed on the transfer belt 51 directly contacts the transfer roller 65 without assistance of a separate cleaning unit (not shown). During the printing operation, the printing medium 306 passes through the gap between the transfer belt 51 and the transfer roller 65. Accordingly, the visible image 302*a* formed on the outer surface 51*b* of the transfer belt 51 is normally transferred to the printing medium 306, and thus the transfer roller 65 is not contaminated. In addition, the ACR test patterns 304*a* do not contact the transfer roller 65. Accordingly, even if the ACR test pattern 304*a* is not cleaned, the ACR test patterns 304*a* pass through the transfer roller 65 without contaminating the transfer roller 65 after being detected by the test pattern detectors 59. Then, ACR test patterns 304*a* are cleaned and removed from the transfer belt 51 by the cleaning unit (not shown) before another ACR test pattern is formed.

As shown in FIG. 7, the transfer roller 65 is positioned at the center of the transfer belt 51 in the primary scanning direction, and has a length that covers the length of the image forming area 302 but does not reach the test pattern forming area 304. The transfer roller 65 is positioned at the center of the transfer belt 51 in the primary scanning direction since the image forming area 302 is positioned at the center of the transfer belt 51 in the primary scanning direction. In addition, the length of the transfer roller 65 is designed to cover the length of the image forming area 302 but not to reach the test pattern forming area 304, such that the transfer roller 65 is involved in formation of the visible image 302*a* in the image forming area 302, not in formation of the ACR test patterns 304*a* in the test pattern forming area 304, and is not contaminated by the ACR test patterns 304*a*.

The relationship between the lengths of the transfer roller 51, photosensitive medium 31, the developing roller 32, and the charging roller 33 to the length of the transfer belt 51 in the primary scanning direction (i.e., the width of the transfer belt 51) illustrated in FIG. 7 is the same as the relationship of the lengths previously described with reference to FIGS. 5A and 5B. That is, the maximum transfer length L_transfer allowing transfer of the developing agent to the printing medium 306 corresponds to the overlapping portions of the transfer roller 65 and the transfer belt 51. The maximum transfer length L_transfer is equal to the length (the length in the primary scanning direction) of the image forming area 302. Herein, contamination of the transfer roller 65 by the ACR test patterns 304*a* does not occur only when the maximum transfer length L_transfer is less than the maximum image forming length L_image.

The maximum image forming length L_image, namely the maximum length of an image developed on the photosensitive medium 31 is the length of the overlapping portion of the charging roller length (L_ch), the photosensitive medium length (L_opc), and the developing roller length (L_de). In a part of the overlapping portion which is exposed to light from a laser scanning unit (not shown), the developing agent (toner) from the developing roller 32 is formed. The maximum image forming length L_image includes both the length of the image forming area 302 in which the visible image 302*a* is formed, and the length of the test pattern area 304 in which the ACR test patterns 304*a* are formed. Of the maximum image forming length L_image, the length (the length in the primary scanning direction) of the image forming area 302 is determined as the maximum length of the printing medium 306 supported by the image forming apparatus.

To implement both the visible image 302*a* and the ACR test patterns 304*a* and prevent contamination of the transfer roller 65, the maximum transfer length L_transfer and the maximum image forming length L_image should satisfy the relation of L_transfer<L_image, and the position where the maximum transfer length L_transfer is provided should be set at the location corresponding to the image forming area 302 out of the test pattern forming area 304. This serves to prevent contamination of the transfer roller 65 by the ACR test pattern 304*a* by limiting the length and position of the image forming area 302 where the visible image 302*a* may be formed, specifically by setting the position at a location out of the test pattern forming area 304 since the maximum transfer length L_transfer is involved in forming the visible image 302*a* in the image forming area 302. In addition, to print an image on the printing medium 306 with the maximum size supported by the image forming apparatus, the maximum transfer length L_transfer needs to be greater than the length in the primary scanning direction (i.e., the lateral width) L_medium of the printing medium 306. That is, to prevent contamination of the transfer roller 65 and ensure normal printing, the relation of L_medium<L_transfer<L_image should be satisfied.

As is apparent from the above description, an image forming apparatus having a developing unit, an intermediate transfer body, and a transfer roller according to one or more embodiments may prevent contamination of the transfer roller and the printing medium by the toner remaining in the test pattern forming area of an intermediate transfer body.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a developing unit to form an electrostatic latent image and allow an image to be formed by a developing agent supplied to the electrostatic latent image;

an intermediate transfer body having an image forming area and a test pattern forming area arranged in parallel in a primary scanning direction, wherein the image is transferred from the developing unit to the image forming area and the test pattern forming area; and a transfer roller allowing the image transferred to the image forming area of the intermediate transfer body to be transferred to a printing medium, wherein a maximum transfer length, which is a maximum length of the transfer roller allowing transfer of the image to the printing medium, is less than a maximum image forming length, which is a maximum length of the developing unit allowing the image to be developed, wherein the transfer roller is positioned so that the maximum transfer length of the transfer roller corresponds to the image forming area of the intermediate transfer body, which is outside of the test pattern forming area of the intermediate transfer body.

2. The image forming apparatus according to claim 1, wherein:

the developing unit comprises a photosensitive medium, a developing roller, and a charging roller, and portions of the photosensitive medium, developing roller, and charging roller overlap each other in the primary scanning direction which corresponds to the maximum image forming length.

3. The image forming apparatus according to claim 2, wherein the maximum image forming length includes a length of the test pattern forming area and a length of the image forming area.

4. The image forming apparatus according to claim 1, wherein the maximum transfer length of the transfer roller is greater than a length in the primary scanning direction of a printing medium with the largest size supported by the image forming apparatus.

5. The image forming apparatus according to claim 1, wherein a cleaning unit to clean only a test pattern formed in the test pattern forming area is installed at a position corresponding to the test pattern forming area in the image forming apparatus.

6. The image forming apparatus according to claim 1, wherein the intermediate transfer body is a transfer belt.

7. The image forming apparatus according to claim 1, wherein the intermediate transfer body is a transfer drum.

8. An image forming apparatus comprising:

a developing unit to form an electrostatic latent image and allow an image to be formed by a developing agent supplied to the electrostatic latent image;

an intermediate transfer body having an image forming area and two test pattern forming areas arranged at both sides of the image forming area to be parallel with the image forming area in a primary scanning direction, wherein the image is transferred from the developing unit to the image forming area and the two test pattern forming areas, wherein the two test pattern forming areas include a first test pattern forming area formed on one side of the image forming area and a second test pattern forming area formed on the other side of the image forming area; and a transfer roller allowing the image transferred to the image forming area of the intermediate transfer body to be transferred to a printing medium, wherein a maximum transfer length, which is a maximum length of the transfer roller allowing transfer of the image to the printing medium is less than a maximum image forming length, which is a maximum length of the developing unit allowing the image to be developed, wherein the transfer roller is positioned so that the maximum transfer length of the transfer roller corresponds to the image forming area of the intermediate transfer body, which is outside of the two test pattern forming areas of the intermediate transfer body.

9. The image forming apparatus according to claim 8, wherein:

the developing unit comprises a photosensitive medium, a developing roller, and a charging roller, and portions of the photosensitive medium, developing roller, and charging roller overlap each other in the primary scanning direction which corresponds to the maximum image forming length.

10. The image forming apparatus according to claim 9, wherein the maximum image forming length includes lengths of the two test pattern forming areas and a length of the image forming area.

11. The image forming apparatus according to claim 8, wherein the maximum transfer length of the transfer roller is greater than a length in the primary scanning direction of a printing medium with the largest size supported by the image forming apparatus.

12. The image forming apparatus according to claim 8, wherein two cleaning units to clean only test patterns formed in the two test pattern forming areas are installed at positions corresponding to the two test pattern forming areas in the image forming apparatus.

13. The image forming apparatus according to claim 8, wherein the intermediate transfer body is a transfer belt.

14. The image forming apparatus according to claim 8, wherein the intermediate transfer body is a transfer drum.

* * * * *